United States Patent [19]

Maas et al.

[11] 4,016,923

[45] Apr. 12, 1977

[54] PROCESS FOR HOT TOPPING BY ELECTRO-SLAG-REMELTING

[75] Inventors: Hermann Maas, Bochum; Georg von Bormann, Kaarst, both of Germany

[73] Assignee: August Thyssen-Hutte AG, Duisburg-Hamborn, Germany

[22] Filed: Aug. 20, 1975

[21] Appl. No.: 607,123

[30] Foreign Application Priority Data

Aug. 23, 1974 Germany ..... 2440360

[52] U.S. Cl. ..... 164/52; 164/94

[51] Int. Cl.[2] ..... B22D 23/02

[58] Field of Search ..... 164/52, 252, 55, 56, 164/94, 95, 96, 123, DI. 6

[56] References Cited

UNITED STATES PATENTS

| | | | |
|---|---|---|---|
| 2,086,437 | 7/1937 | Rowe | 164/94 |
| 2,240,405 | 4/1941 | Kinzel | 164/52 |
| 2,694,023 | 11/1954 | Hopkins | 164/52 X |
| 3,626,072 | 12/1971 | Harolampiev et al. | 164/52 X |
| 3,687,189 | 8/1972 | Zuev et al. | 164/52 |
| 3,794,104 | 2/1974 | Medovar et al. | 164/252 |
| 3,894,574 | 7/1975 | Paton et al. | 164/52 |

FOREIGN PATENTS OR APPLICATIONS

| | | | |
|---|---|---|---|
| 949,781 | 2/1964 | United Kingdom | 164/123 |

*Primary Examiner*—Ronald J. Shore
*Attorney, Agent, or Firm*—Burgess, Dinklage & Sprung

[57] ABSTRACT

A process for hot topping by electro-slag-remelting in which before or before and during hot-topping a portion of the liquid remelting slag in the mold is removed in order to achieve a hot topping of the ingot under a reduced amount of slag.

8 Claims, 2 Drawing Figures

PROCESS FOR HOT TOPPING BY ELECTRO-SLAG-REMELTING

BACKGROUND OF THE INVENTION

1. Field of the Invention

For this invention relates to a process for hot topping an ingot produced by the electro-slag-remelting process, in which the remelting takes place at the end of the remelting process with a reduced power as compared to that achieved during the normal remelting.

2. Discussion of the Prior Art

Proceeding at the end of the remelting process with reduced power in order to fill up the shrinking hole, which is formed by the solidification of the liquid metal crater, is already known. In the known process the electric power is reduced step by step. With ingots produced by the electro-slag-remelting process, which have a large diameter the amount of slag needed for the remelting, is predominantly large and the heat content of the slag is very difficult to control electrically. This is rendered more difficult by the fact that a small solidified layer of slag on the wall of the mould effects excellent heat insulation.

The object of the invention consists in developing a process for hot topping by electro-slag-remelting, in which the temperature in the slag bath, the solidification process and the remelting by the electrode for hot topping can be well adjusted through suitable steps.

SUMMARY OF THE INVENTION

This object is solved according to the invention in that the hot topping of the ingot is achieved under a reduced amount of slag as compared to the remelting, for which a portion of the liquid remelting slag in the mould is removed. 40 to 80% by volume of the liquid remelting slag is preferably removed.

The portion of the remelting slag to be removed is, according to a preferred step in process, removed in separate steps. The removal in separate steps is preferred for ingots having a diameter of 1000 mm or more. The first step should be made directly after the remelting is finished but before the hot topping has begun. A graduation is of advantage in which 20 to 50% by volume of the remelting slag is removed in the first step and 10 to 25 % by volume is removed in each of the two following steps. It is favourable to undertake the removal in steps of the liquid remelting slag together with the reduction in steps of the electric power. It is however also possible to continually reduce the power with the removal in steps of the slag.

In the known hot topping processes the surface of the slag starts to solidify on reduction of the power for reducing the remelting power. This leads to a reduced heat flow from the system due to the insulating effect of the solidified layer of slag. With the process according to the invention the total heat content of the amount of slag present is abruptly diminished due to the reduction in the amount of slag. It is hereby possible despite the lower energy requirement to resupply power for the hot topping, whereby the slag is maintained in the liquid state. The insulating effect of a solidified layer is hereby lifted and a larger amount of energy is emitted from the system. The effect of the reduction in the amount of slag that in total a greater emission of energy could be achieved despite a reduced supply of energy via the remelting electrode, could not be foreseen. In this way the complete system comprisng electrode, ingot and slag become more flexible and more easily controllable through the reduction of the amount of slag according to the invention on hot topping, and the speed of the remelting and that of the hot topping feed are well coordinated. The amount of slag to be applied is chosen according to the dimensions of the ingot, to the heating power and the cooling power of the system.

DESCRIPTION OF PREFERRED EMBODIMENTS

The invention can be formed in detail as follows:

A particular advantage consists in that the remelting power of the electrode can be precisely coordinated to the shrinking process of the remaining melt through reducing the amount of slag in separate steps. In so doing the number of steps is arranged according to the shrinking (crater) capacity of the ESR-ingot among other factors.

The portion of the remelting slag to be removed can be removed in one step according the form and quality of the ingot before the hot topping has begun. The one step removal is preferred for ingots having a diameter of less than 1000 mm.

The height of the slag bath can easily be defined exactly, e.g. over the depth of immersion of the suction nozzle due to the fact that the reduction of the remelting slag is achieved by suction. It is in addition possible to ensure that no liquid steel is removed with the slag by regulating the suction power.

A portion of the remelting slag can be removed particularly easily by being allowed to flow out. The mould is provided with discharge channel for this purpose. The reduction of the amount of slag is then achieved in that one or several closable apertures are positioned in the mould within the area of the slag bath. The level in the slag bath can be lowered to the required level by allowing the slag to flow out of one of the apertures. In order to achieve a secure hot topping, the aperture can be closed again after part of the slag has been flowed off.

The remaining melt is quickly solidified by completely removing the remelting slag after the hot topping process has finished, and the ingot can be immediaetely developed.

The operation of the invention is described in more detail as follows by means of a drawing.

Individually

Figure 1:
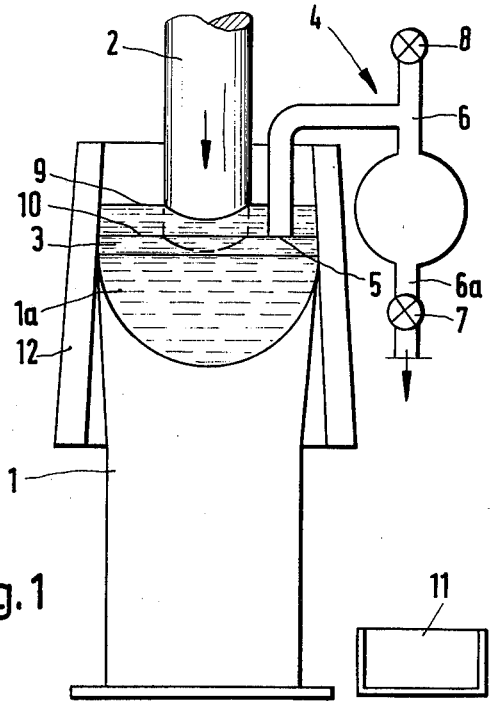
FIG. 1 shows a schematic representation of the suction of the liquid remelting slag before hot topping.

In FIG. 1 the solidified portion of the ingot is designated as number 1 and the liquid crater as 1*a*. The ingot 1 produced by the electro-slag-remelting process is hot topped with a lower power than that achieved in previous remelting by electrode 2. The amount of the liquid remelting slag 3 is to be reduced from level 9 to level 10. The reduction of the amount of slag is achieved by suction by the siphon 4. The siphon 4 is plunged with the end 5 of the suction pipe into the liquid slag 3. The suction pipe opens into a connecting pipe 6, the lower end of 6*a* of which can be closed by means of a flap 7 and its upper end leading to a suction pump (not shown) can be closed by a slide plate 8. The siphon 4 is plunged with the end 5 into the liquid remelting slag 3 for the suction process. The flap 7 is then closed and the siphon 4 is evacuated by means of the suction pump. The flap 7 is opened after the slag has flowed in and the slide plate 8 is closed. The slag 3 is decreased from level 9 to level 10 after the suction process, whereby level 10 coordinates with the level of immersion of the end 5 of the siphon 4. The slag removed by the suction flows off into the slag part 11.

Figure 2:
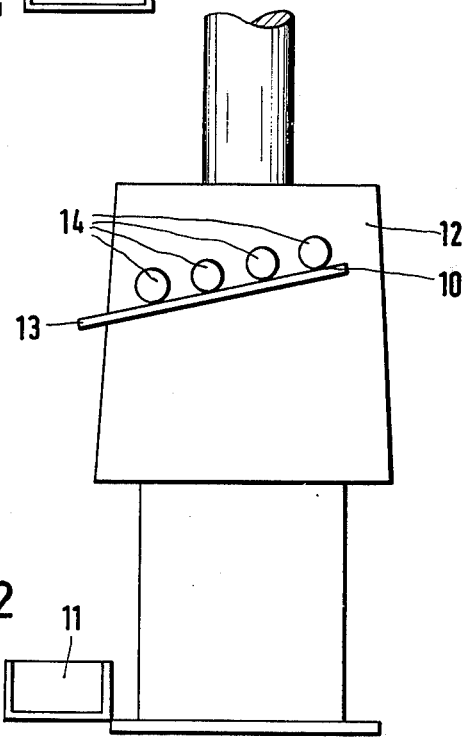
FIG. 2 shows the flowing out of the remelting slag.

According to FIG. 2 the lowering of the level of the slag from level 9 to level 10 is achieved through the apertures 14 provided in the mould. The slag flows out of one of the apertures 14 through the discharge channel 13 into the slag part 11. The apertures 14 are closed during the remelting process, e.g. with a fitted copper part cooled by water, and the required aperture is opened when needed and then closed again.

The following examples explain the remelting process in more detail. Suitable known compositions of slag were used as remelting slag.

EXAMPLE 1

A low-alloyed Ni-Cr-Mo-V rotor-steel was remelted with an ingot diameter of 1350 mm. The remelting was achieved at 2000 KVA (kilovolt-amperes). After this remelting process is finished the hot topping was carried out in the following steps:

1st step—Removal of 30% by volume of the liquid remelting slag by a suction then hot topping at 1000 KVA for 0.7 hours.

2nd step—Removal of 20% by volume of the liquid remelting slag, then hot topping at 500 KVA for 0.7 hours.

3rd step—Removal of 20% by volume of the liquid remelting slag, then hot topping at 300 KVA for 0.7 hours.

Finally the remaining 30% by volume of the liquid remelting slag is removed by suction and the ingot is stripped. The total time taken in the production amounts to 2.3 hours as compared with 6 hours (3 hours hot topping and 3 hours cooling time) needed with the prior art.

EXAMPLE 2

An unalloyed carbon steel (SAE 1010) with an ingot diameter of 900 mm was remelted at 1000 KVA. Before the start of the hot topping 50% by volume of the liquid remelting slag was removed by being allowed to flow out or by suction. The hot topping was then carried out at 500 KVA for 0.3 hours and then at 300 KVA for 0.5 hours and thereafter at 180 KVA for 0.5 hours. Then the remaining 150% by volume of the remelting slag was removed by suction and the ingot was stripped. The total time taken in the production amounts to 1.5 hours as compared with 4 hours needed with the prior art.

We claim:

1. In an electro-slag-remelting process wherein a mass of steel in the form of an electrode is remelted while inserted in slag to produce an ingot and at the end of said remelting carrying out a hot topping process wherein said electrode is supplied with a reduced power as compared to that achieved during said remelting while inserted in said slag, the improvement which comprises subsequent to said electro-slag-remelting and prior to said hot topping removing a portion of said slag.

2. A process according to claim 1 wherein in total between 40 and 80% by volume of the slag is removed.

3. A process according to claim 1 wherein in a first step prior to said hot topping 20 to 50% by volume of said slag is removed and in two following steps during said hot topping each 10 to 25% by volume of the remelting slag is removed.

4. A process according to claim 1 wherein the remelting slag which is removed is all removed prior to commencement of the hot topping process.

5. A process according to claim 1 wherein at least a portion of the remelting slag is removed by suction.

6. A process according to claim 1 wherein at least a portion of the remelting slag is removed by allowing it to flow out of an opening in a mold in which said slag and steel are disposed.

7. A process according to claim 1 wherein at least a portion of the slag is removed prior to said hot topping process and additional slag is removed during said hot topping process.

8. A process according to claim 7 wherein said slag is removed in a series of separate steps.

* * * * *

UNITED STATES PATENT AND TRADEMARK OFFICE

CERTIFICATE OF CORRECTION

PATENT NO. : 4,016,923

DATED : April 12, 1977

INVENTOR(S) : Hermann Maas et al

It is certified that error appears in the above–identified patent and that said Letters Patent are hereby corrected as shown below:

Column 4, claim 3, line 1, change "1" to -- 7 --.

claim 7, line 1, delete "at least".

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*